US008690245B2

(12) United States Patent
Tuckey

(10) Patent No.: US 8,690,245 B2
(45) Date of Patent: Apr. 8, 2014

(54) SOOTHING APPARATUS AND INFANT SEAT THEREWITH

(75) Inventor: Peter R. Tuckey, Morgantown, PA (US)

(73) Assignee: Wonderland Nurserygoods Company Limited, Central, Hong Kong (HK)

( * ) Notice: Subject to any disclaimer, the term of this patent is extended or adjusted under 35 U.S.C. 154(b) by 155 days.

(21) Appl. No.: 13/298,311

(22) Filed: Nov. 17, 2011

(65) Prior Publication Data

US 2012/0292966 A1 Nov. 22, 2012

Related U.S. Application Data

(60) Provisional application No. 61/458,168, filed on Nov. 18, 2010.

(51) Int. Cl.
*A47D 13/10* (2006.01)

(52) U.S. Cl.
USPC ..... 297/274; 297/260.2

(58) Field of Classification Search
USPC ..... 297/274, 273, 260.2, 260.1
See application file for complete search history.

(56) References Cited

U.S. PATENT DOCUMENTS 5,660,430 A * 8/1997 Clarke ..... 297/130
7,669,927 B1 * 3/2010 Zaid ..... 297/260.2
7,918,505 B2 * 4/2011 Raphael et al. ..... 297/260.2
2007/0007804 A1 * 1/2007 Pemberton et al. ..... 297/260.2
2007/0200208 A1 * 8/2007 Wang ..... 257/668
2007/0262627 A1 * 11/2007 Clapper et al. ..... 297/260.2
2008/0238163 A1 * 10/2008 Bellows et al. ..... 297/274
2009/0181780 A1 * 7/2009 Myers et al. ..... 472/119
2009/0206642 A1 * 8/2009 Raphael et al. ..... 297/217.3
2010/0320810 A1 * 12/2010 Chen ..... 297/118
2012/0261962 A1 * 10/2012 Huntsberger et al. ..... 297/260.2
2013/0229040 A1 * 9/2013 Mountz ..... 297/260.2

FOREIGN PATENT DOCUMENTS

CN 1779297 A 5/2006

* cited by examiner

*Primary Examiner* — David R Dunn
*Assistant Examiner* — Alexander Harrison
(74) *Attorney, Agent, or Firm* — Winston Hsu; Scott Margo

(57) ABSTRACT

A soothing apparatus and an infant seat therewith are disclosed. The soothing apparatus includes an apparatus base, a seat base disposed on the apparatus, and a driving device including a driving part and a follower disposed on the apparatus base and the seat base oppositely. The driving part has an interfering surface with a specific profile. The follower keeps contacting the interfering surface such that the seat base is moved through the follower relative to the apparatus base in accordance with the specific profile when the interfering surface moves relative to the follower. Thereby, the soothing apparatus can provide an specific soothing motion and further provide another variant soothing motion by just creating another specific profile, so that the invention can provide a more flexible mechanism than that in the prior art.

14 Claims, 11 Drawing Sheets

SOOTHING APPARATUS AND INFANT SEAT THEREWITH

CROSS REFERENCE TO RELATED APPLICATIONS

This application claims the benefit of U.S. Provisional Application No. 61/458,168, which was filed on Nov. 18, 2010 and is incorporated herein by reference.

BACKGROUND OF THE INVENTION

1. Field of the Invention

The invention relates to a soothing apparatus and an infant seat, and especially relates to a soothing apparatus for infant seat and an infant seat with a soothing apparatus.

2. Description of the Prior Art

Products that provide motion have been very helpful in providing a soothing and comforting environment for infants. Because of this, products that provide motion for an infant and are also versatile and portable are highly valued. Most of current products providing soothing motion use a base and a platform for sliding on the base, or a support for swinging seat over ground. The soothing mechanism therefor occupies a larger space and even is complicated for stability in structure and motion. Even so, the motion pattern provided by the soothing mechanism is still simplistic and limited, mostly such as a monotonic arc path. If a new motion pattern is required, a great modification will be involved therefor. It brings inconvenience and lack of application flexibility to the user.

SUMMARY OF THE INVENTION

An objective of the invention is to provide a soothing apparatus for infant seat. The soothing apparatus mainly uses a driving device which requires a smaller installation space and is capable of providing multiple soothing motions than the soothing mechanism in the prior art.

The soothing apparatus of the invention is used for an infant seat and includes an apparatus base, a seat base, and a driving device. The seat base is disposed on the apparatus base. The driving device includes a driving part and a follower. The driving part and the follower are disposed on the apparatus base and the seat base oppositely. In an embodiment, the driving part is disposed on the apparatus base; the follower is disposed on the seat base. The driving part has an interfering surface with a specific profile. The follower keeps contacting the interfering surface such that the seat base is moved through the follower relative to the apparatus base in accordance with the specific profile when the interfering surface moves relative to the follower. Thereby, the installation space for the driving device can be localized relative to the whole structure of the apparatus base and the seat base. Furthermore, the soothing apparatus can provide an specific soothing motion by use mainly of the follower contacting the interfering surface, and further can provide another variant soothing motion by just creating another specific profile, so that the invention can provide a more flexible mechanism than that in the prior art.

Another objective of the invention is to provide an infant seat with a soothing apparatus of the invention. The infant seat has the soothing apparatus so as to be capable of providing a more complicated soothing motion than the soothing mechanism in the prior art.

The infant seat of the invention includes an apparatus base, a seat assembly, and a driving device. The seat assembly includes a seat base disposed on the apparatus base. The driving device includes a driving part and a follower. The driving part and the follower are disposed on the apparatus base and the seat base oppositely. The driving part has an interfering surface with a specific profile. The follower keeps contacting the interfering surface such that the seat assembly is moved through the follower relative to the apparatus base in accordance with the specific profile when the interfering surface moves relative to the follower. Similarly, the installation space for the driving device can be localized. The infant seat uses the soothing apparatus to provide an specific soothing motion and further provide another variant soothing motion by just creating another specific profile, so that the invention can provide a more flexible mechanism than that in the prior art.

These and other objectives of the present invention will no doubt become obvious to those of ordinary skill in the art after reading the following detailed description of the preferred embodiment that is illustrated in the various figures and drawings.

DETAILED DESCRIPTION

Figure 1:
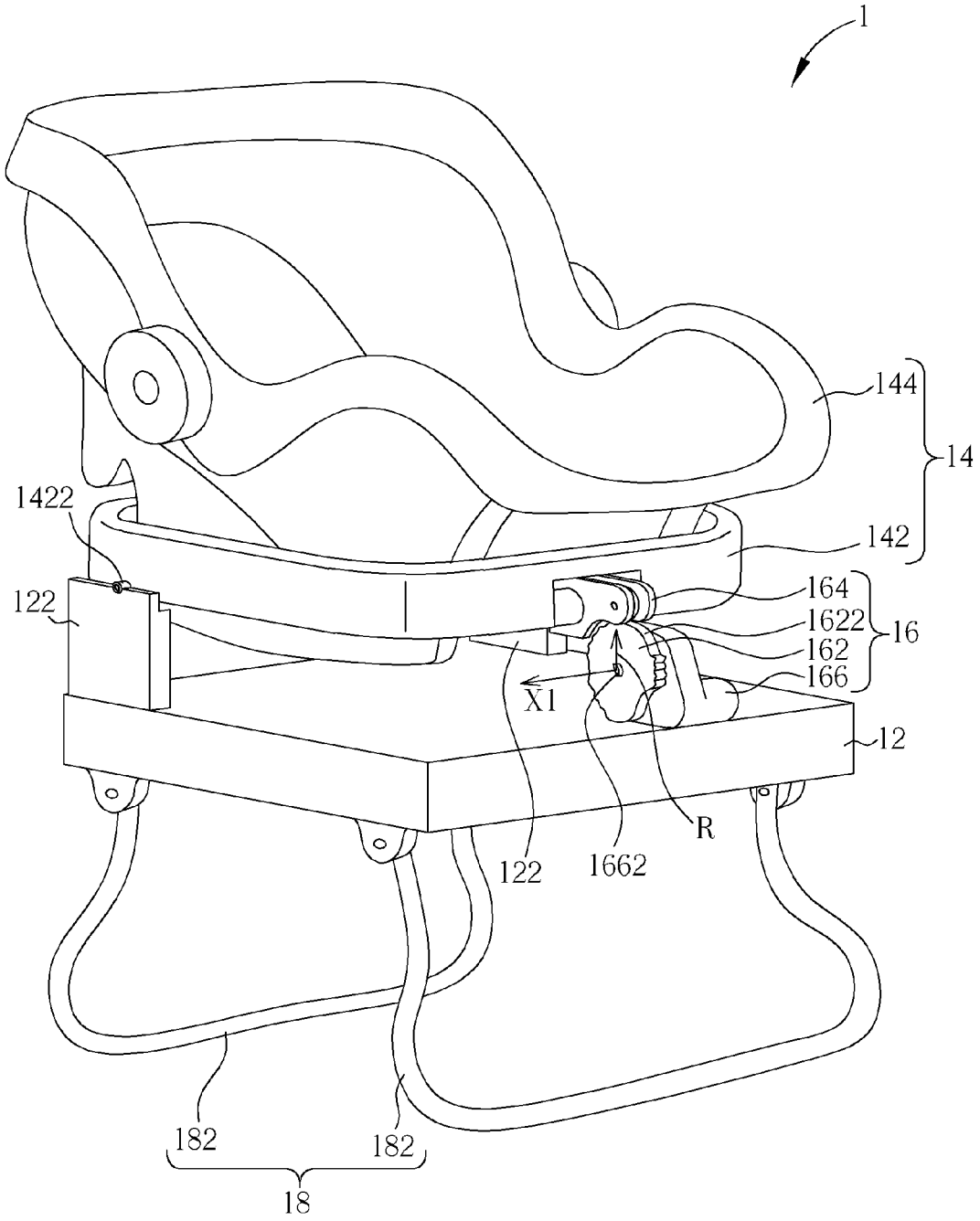
FIG. 1 is a schematic diagram illustrating an infant seat of a preferred embodiment according to the invention.

Please refer to FIG. 1, which is a schematic diagram illustrating an infant seat 1 of a preferred embodiment according to the invention. The infant seat 1 includes an apparatus base 12, a seat assembly 14, a driving device 16, and a supporting structure 18. The seat assembly 14 includes a seat base 142 and a seat 144. The seat base 142 is disposed on the apparatus base 12. The driving device 16 is disposed on and connected to the apparatus base 12 and a seat assembly 14, so that the seat assembly 14 can move relative to the apparatus base 12 through the driving device 16. The soothing mechanism for the driving device 16 will be discussed later. The supporting structure 18 is used for the apparatus base 12 to be placed thereon so that a user can use the infant seat 1 more conveniently.

In the embodiment, the seat assembly 14 is pivotally connected through pins 1422 to supports 122 of the apparatus base 12 by the seat base 142, such that the seat assembly 14 can rotate about the pins 1422. The driving device 16 includes a driving part 162, a follower 164, and a motor 166. The driving part 162 and the follower 164 are disposed on the apparatus base 12 and the seat base 142 oppositely. In the embodiment, the driving part 162 is disposed on the apparatus base 12; the follower 164 is disposed on the seat base 142. In practice, the driving part 162 can be alternatively disposed on the seat base 142; the follower 164 can be disposed on the apparatus base 12 correspondingly. The driving part 162 has an interfering surface 1622 with a specific profile. The follower 164 keeps contacting the interfering surface 1622 such that the seat assembly 14 is moved through the follower 164 relative to the apparatus base 12 in accordance with the specific profile when the interfering surface 1622 moves relative to the follower 164. The driving part 162 is mounted on a rotary shaft 1662 of the motor 166 to be rotated thereby. In practice, the motor 166 may be electrically powered by an external power source and include a gear reduction unit engaged with a motor to obtain a suitable rotary speed for the driving part 162. However, the invention is not limited to it. Any means capable of rotating the driving part 162 can be applied for the invention.

Figure 2:
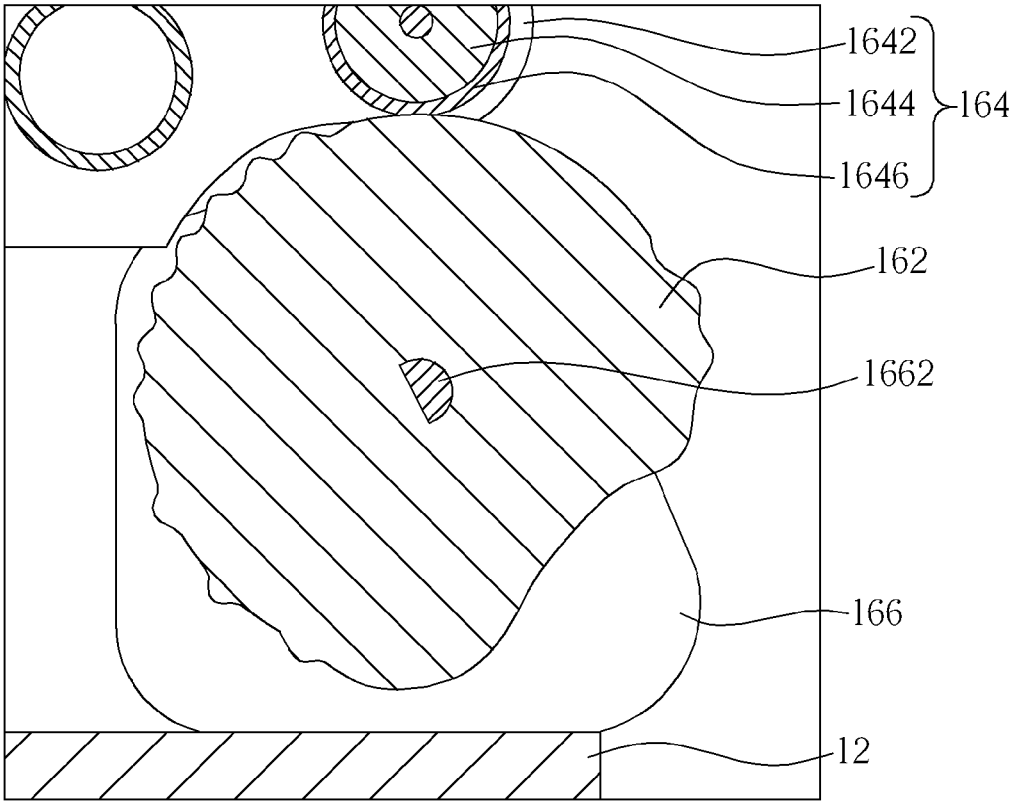
FIG. 2 is a sectional view of a follower and a driving part of the infant seat in FIG. 1.
Figure 3:
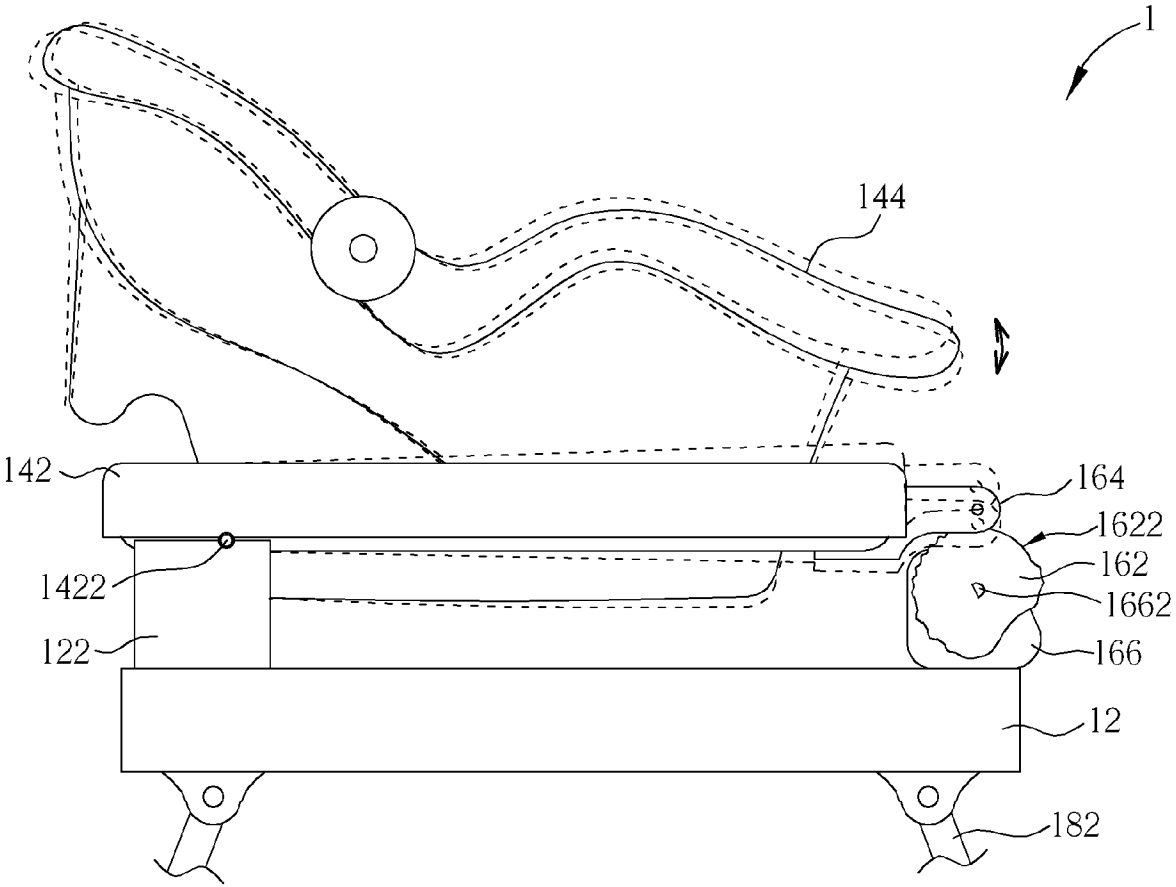
FIG. 3 is a schematic diagram illustrating the soothing motion of the infant seat in FIG. 1.

Please also refer to FIG. 2, which is a sectional view of the follower 164 and the driving part 162. The follower 164 includes a holder 1642 mounted on the seat base 142, and a roller 1644 pivotally connected to the holder 1642. In the embodiment, the roller 1644 is provided with a rubber ring 1646 on the periphery thereof, which can increase the elasticity and friction of the contact of the roller 1644 with the interfering surface 1622 so as to provide a stable soothing motion. Because of the specific profile, the distance between the rotation center of the roller 1644 and the rotation center of the driving part 162 (i.e. the axle center of the rotary shaft 1662 of the motor 166) varies with the rotation angle of the driving part 162, so that the seat base 142 (or the seat assembly 14) is moved up and down accordingly, as shown in FIG. 3. It is noticeable that the actual motion of the seat assembly 14 also depends on the geometric size of the roller 1644 and the interfering surface 1622; for example, if the roller has a relatively large diameter, the roller may not be able to respond to a dense and sharp shape change of the specific profile. In the embodiment, the specific profile is fixed, but in actual application, the user can change the driving part 162 for another required specific profile.

Figure 4:
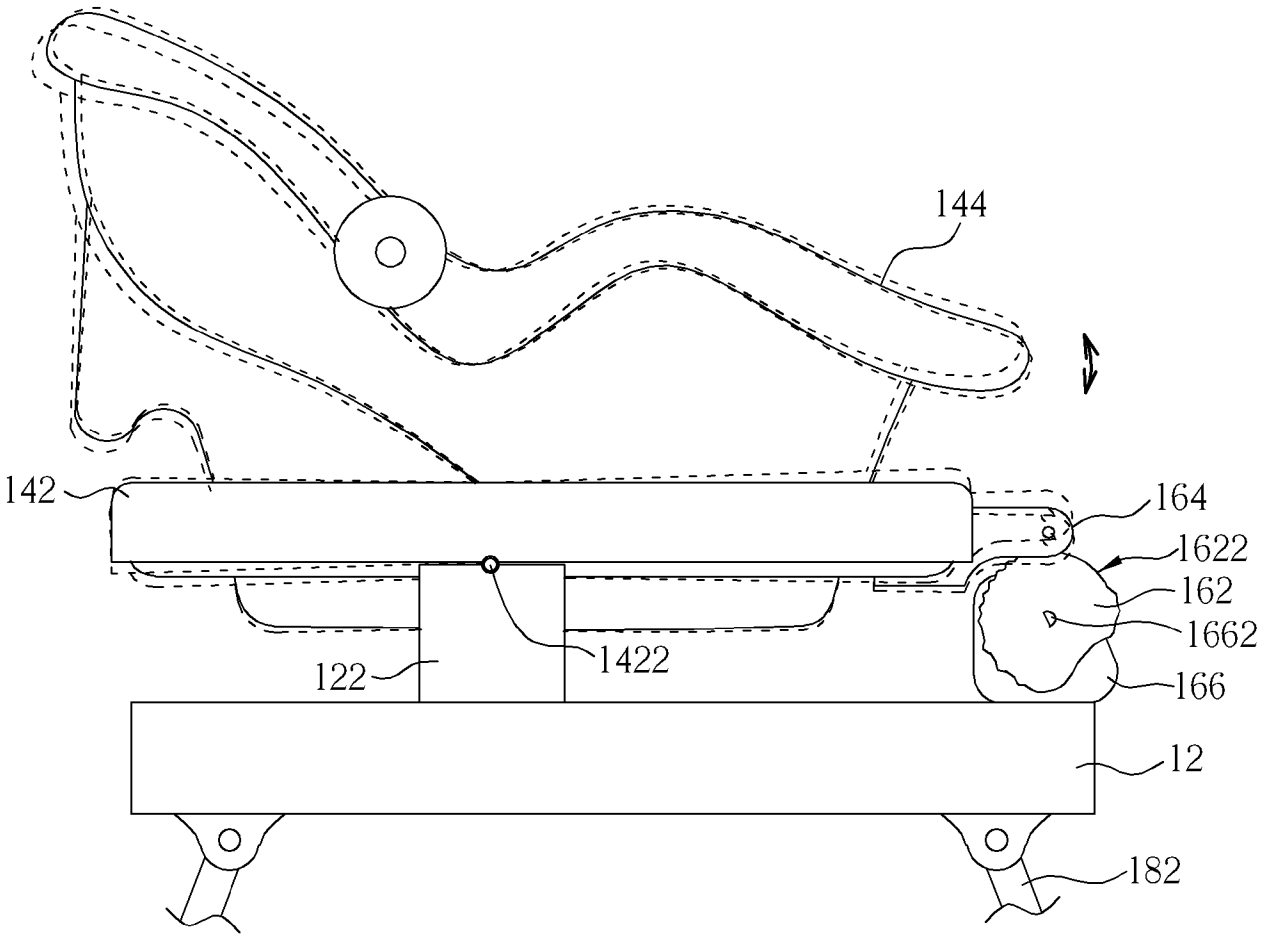
FIG. 4 is a schematic diagram illustrating the soothing motion of the infant seat according to another embodiment.

In the embodiment, the pivotal connection of the seat base 142 onto the apparatus base 12 and the disposition of the motor 16 are located at the front and end portions oppositely substantially, so that the seat assembly 14 soothes like a cantilever; however the invention is not limited thereto. In practice, the pivotal connection of the seat base 142 onto the apparatus base 12 may be shifted close to the geometric center of the seat base 142, so that the seat assembly 14 can soothing like a seesaw under the consideration of the stability of the center of gravity of the seat assembly 14, which induces a larger amplitude of soothing, as shown in FIG. 4.

Figure 5:
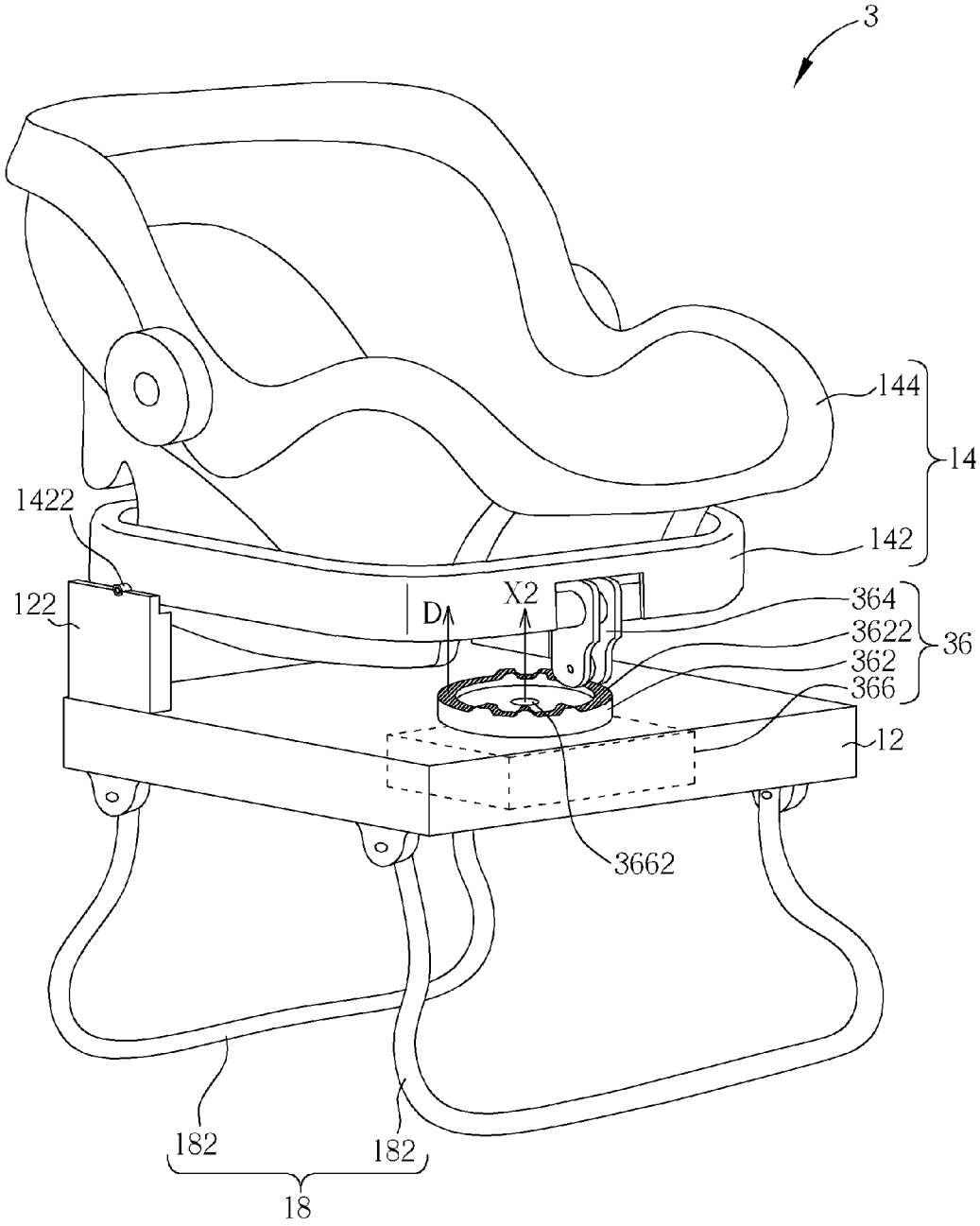
FIG. 5 is a schematic diagram illustrating an infant seat according to another embodiment.

In addition, in the infant seat 1 in FIG. 1, the driving part 162 is a disk rotatable about an axis direction X1 (i.e. the axis direction of the rotary shaft 1662). The interfering surface 1622 is formed at a periphery of the disk, and the specific profile varies in a radial direction R relative to the axis direction. Therefore, the seat base 142 is moved perpendicular to the axis direction X1. However, the invention is not limited it. Please refer to FIG. 1 and FIG. 5. FIG. 5 is a schematic diagram illustrating an infant seat 3 according to another embodiment. The infant seat 3 is structurally similar to the infant seat 1. The main difference therebetween is that the driving device 36 of the infant seat 3 has a driving part 362 different to the driving part 162. The driving part 362 is a disk too. The interfering surface 3622 thereof is formed at a sidewall of the disk, indicated by hatched lines in FIG. 5. The driving part 362 is mounted on the rotary shaft 3662 of the motor 366 of the driving device 36, so as to be rotatable about the axis direction X2 (i.e. the axis direction of the rotary shaft 3662). The follower 364 is structurally modified relative to the follower 164 so as to contact the interfering surface 3622 properly. Because the specific profile of the interfering surface 3622 varies in the direction D parallel to the axis direction X2, the rotary shaft 3662 needs to be disposed perpendicular to the apparatus base 12, such that the seat assembly 14 still can be moved up and down. Therefore, the seat base 142 is moved substantially parallel to the axis direction. Additionally, in this case, the motor 366 can be disposed mostly inside the apparatus base 12. Other related descriptions of the infant seat 3 refer to the above-mentioned description and are not described here.

Figure 6:
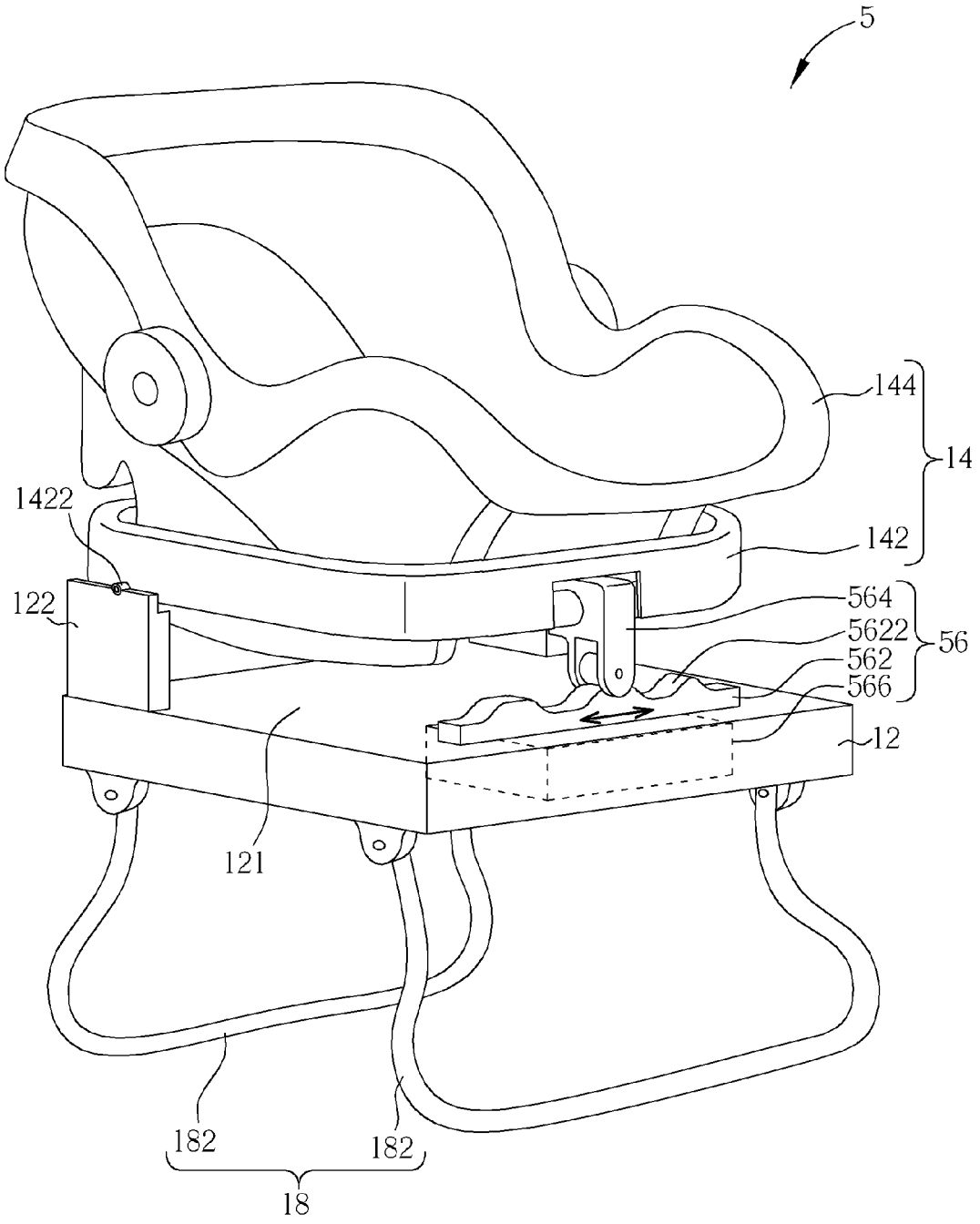
FIG. 6 is a schematic diagram illustrating an infant seat according to another embodiment.

In the above embodiments, the driving devices 16 and 36 perform soothing motion by cam mechanism. The driving part 162 can be regarded as a plate cam; the driving part 362 can be regarded as a simplified cylindrical cam. They provide varying specific profiles of the interfering surfaces 1622 and 3622 by being rotated. In practice, the cam mechanism can be performed by a linear cam. Pleaser refer to FIG. 6, which is a schematic diagram illustrating an infant seat 5 according to another embodiment. The infant seat 5 is structurally similar to the infant seat 1. The main difference therebetween is that the motor 56 of the infant seat 5 has a driving part 562 different to the driving part 162. The driving part 562 can be regarded as a linear cam and moved parallel to a surface 121 of the apparatus base 12. The motor 566 of the driving device 56 can be disposed mostly inside the apparatus base 12 and provide linear motion (indicated by a bold double-arrow in FIG. 6) to the driving part 562. The follower 564 of the motor 56 is mounted on the seat base 142 and keeps contacting the interfering surface 5622 formed on the upper surface of the driving part 562; therefore, the seat base 142 can also be moved up and down in accordance with the specific profile of the interfering surface 5622. Other related descriptions of the infant seat 5 refer to the above-mentioned description and are not described here.

Figure 7:
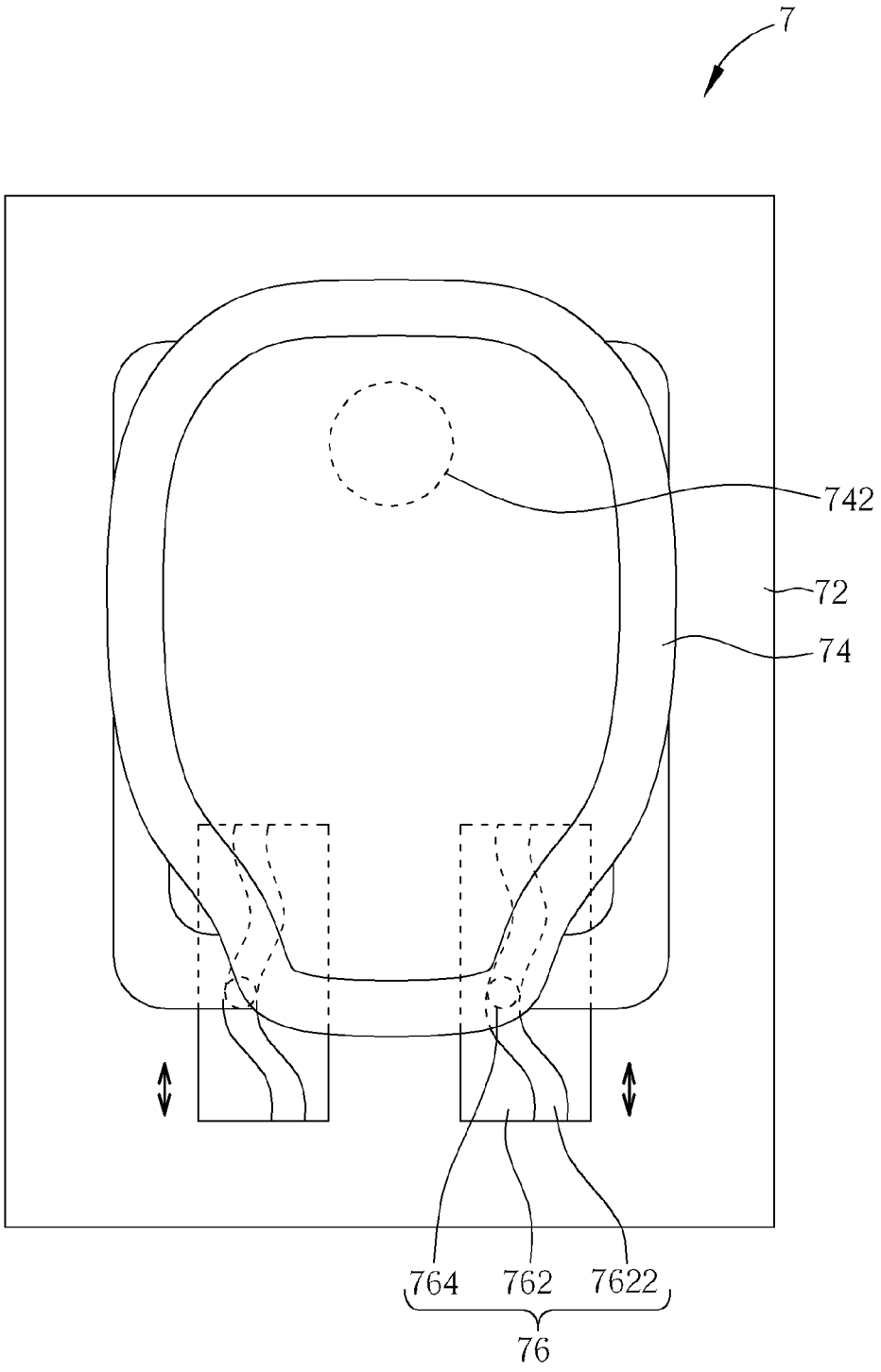
FIG. 7 is a schematic diagram illustrating the soothing motion of an infant seat according to another embodiment.

In the above embodiments, the seat base 142 (or the seat assembly 14) is moved vertically by the driving devices 16, 36 and 56. However, the invention is not limited thereto. In practice, the driving device of the invention can be designed to move the seat assembly horizontally. Please refer to FIG. 7, which is a schematic diagram illustrating the soothing motion of an infant seat 7 according to another embodiment. The following description will be focused on the difference between the soothing mechanisms of the infant seat 7 and any one of the abovementioned infant seat 1, 3, and 5. The seat assembly 74 is pivotally connected to the apparatus base 72 by a pivotal shaft 742. The driving device 76 of the infant seat 7 includes a driving part 762 and a follower 764. The driving part 762 is provided with a guiding groove 7622. The guiding groove 7622 provides an interfering surface by its inner wall surfaces. The follower 764 is guided by the guiding groove 7622 to slide therein. In the embodiment, the driving part 762 is moved linearly by a motor (not shown in FIG. 7) disposed inside the apparatus base 72, indicated by a bold double-arrow in FIG. 7. When the driving part 762 is moved front and rear, the follower 764 is guided to move left and right. Thereby, the seat assembly 74 can be moved horizontally about the pivotal shaft 742 relative to the apparatus base 72. In addition, in the embodiment, there are two sets of the driving device 76 for soothing stably. Other related descriptions of the infant seat 7 refer to the above-mentioned description and are not described here.

Figure 8:
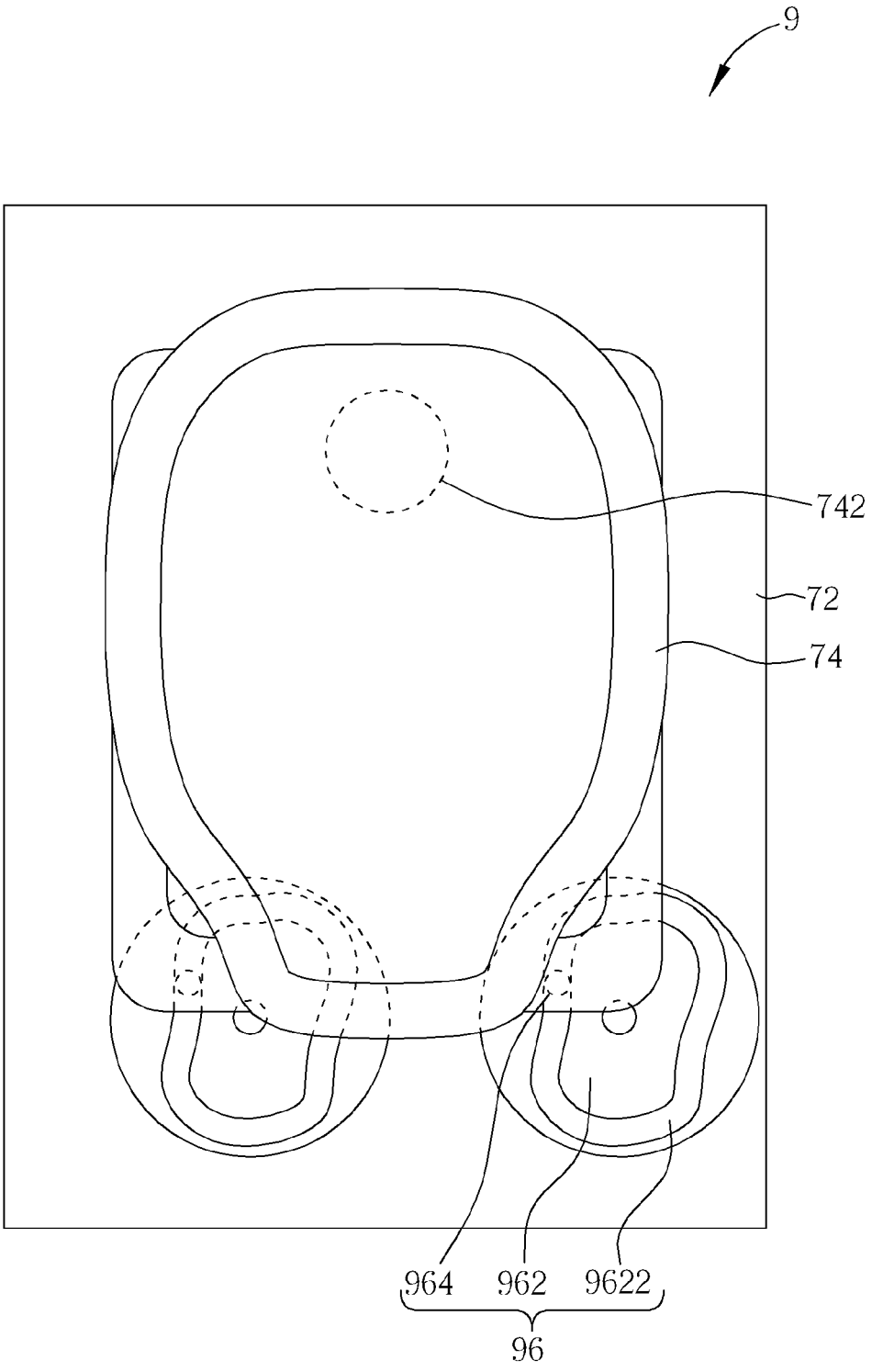
FIG. 8 is a schematic diagram illustrating the soothing motion of an infant seat according to another embodiment.

Please refer to FIG. 8, which is a schematic diagram illustrating the soothing motion of an infant seat 9 according to another embodiment. The infant seat 9 is structurally similar to the infant seat 7. The main difference between the infant seat 9 and the infant seat 7 is that the driving part 962 of the driving device 96 is rotary and provided with a circular guiding groove 9622. By rotating the driving part 962, the follower 964 is guiding by the guiding groove 9622 so as to move the seat assembly 74 horizontally about the pivotal shaft 742. Other related descriptions of the infant seat 9 refer to the above-mentioned description and are not described here.

Figure 9:
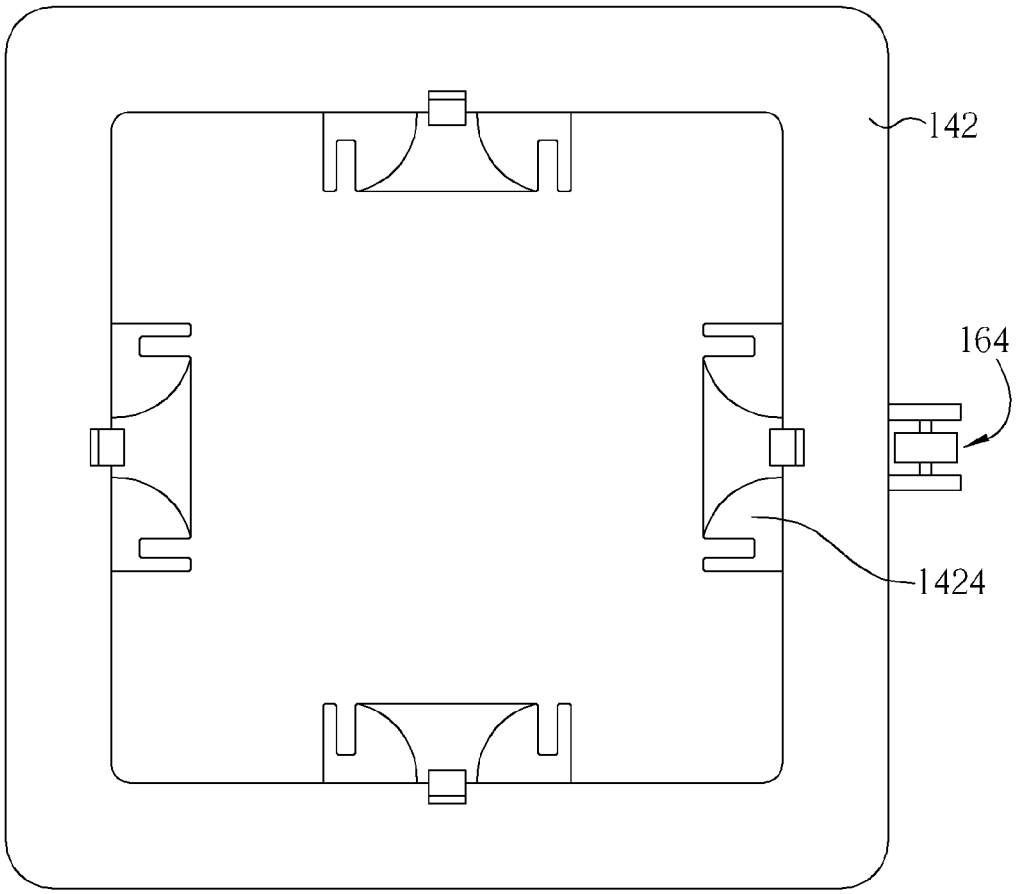
FIG. 9 is a top view of a seat base of the infant seat in FIG. 1.

Please refer back to FIG. 1 and FIG. 9. FIG. 9 is a top view of the seat base 142 in FIG. 1. The seat base 142 has a docking structure 1424 for the seat 144 to be docked firmly with in various orientations. In FIG. 1, the seat 144 is placed in a front-and-rear orientation; in practice, the user can certainly place the seat 144 on the seat base 142 in a left-and-right orientation, which can provide the child seated in the seat 144 a different feeling even under the same specific profile.

Figure 10:
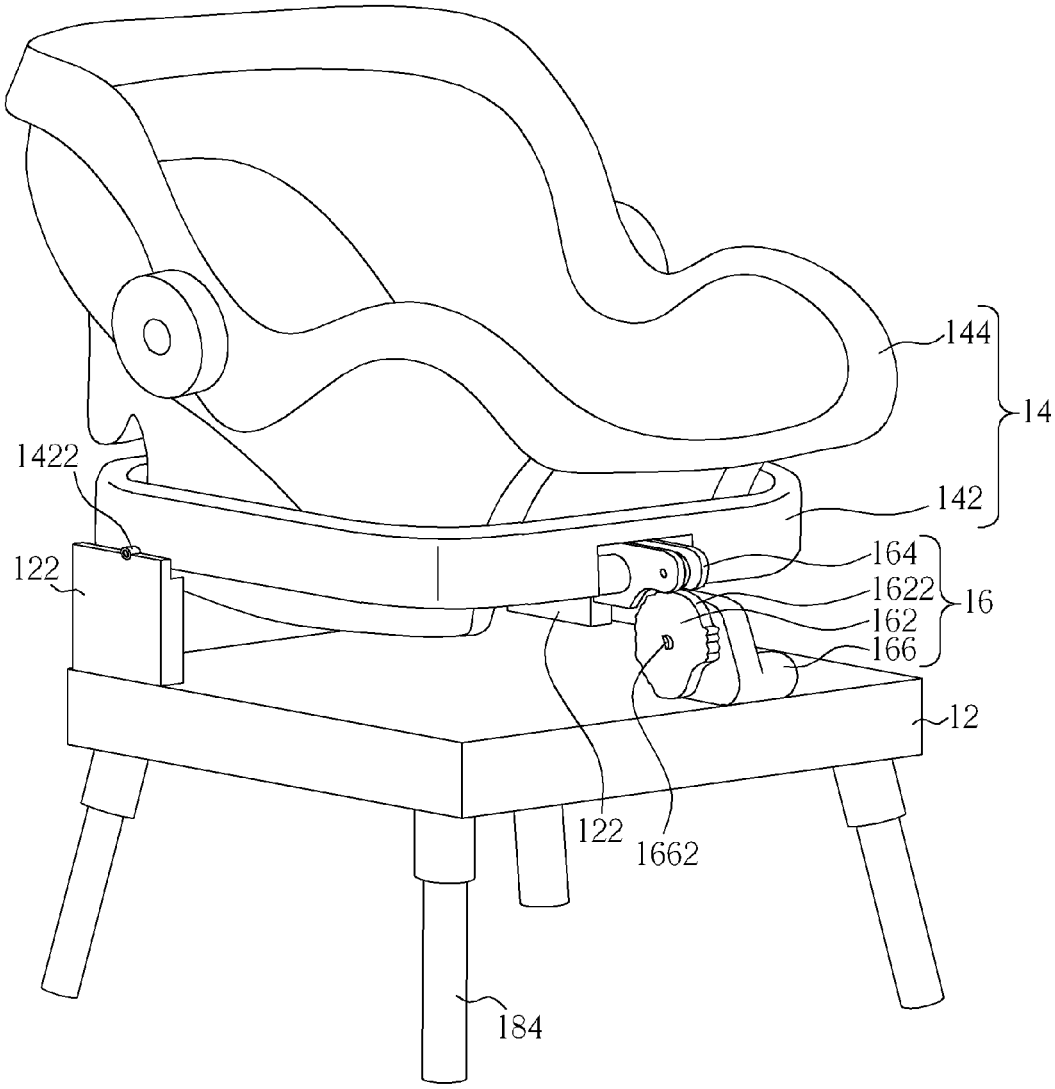
FIG. 10 is a schematic diagram illustrating an infant seat with attachable legs according to another embodiment.
Figure 11:
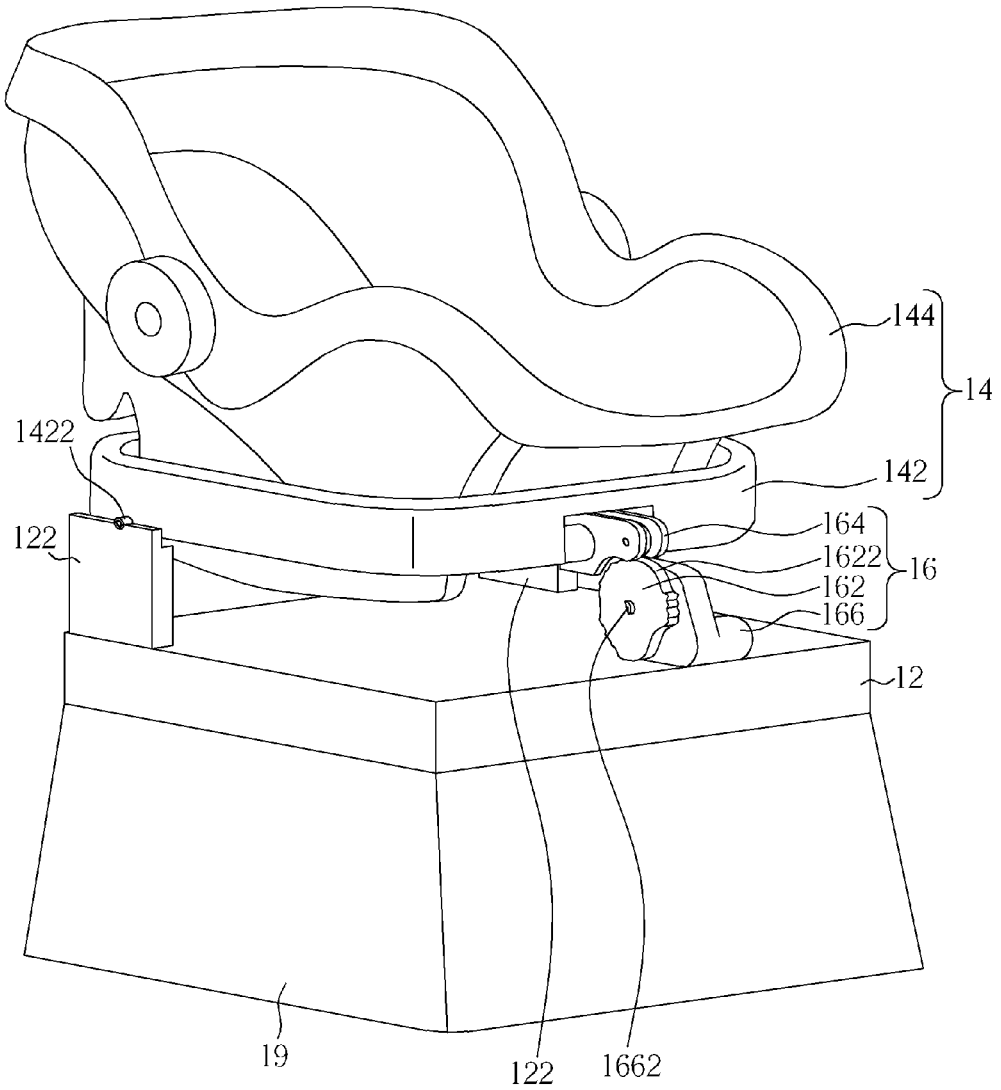
FIG. 11 is a schematic diagram illustrating an infant seat with a pedestal according to another embodiment.

Please refer to FIG. 1. In the embodiment, the supporting structure 18 includes two foldable legs 182. By the supporting structure 18, the apparatus base 12 can be lifted by a height for convenience of the user. After the foldable legs 182 are folded, the infant seat 1 is suitable for storage. In practice, the design spirit of the supporting structure can be realized by a plurality of attachable legs 184, as shown in FIG. 10, or by a pedestal 19, as shown in FIG. 11.

In addition, in the above embodiments, the seat assembly 14 is assembled mainly by the seat base 142 and the seat 144. Therefore, in a practical use, the infant seat without the seat can be regarded as a soothing apparatus; in other words, a seat or the alike (such as cradle or infant carrier of safety seat) can be placed on the soothing apparatus to be swung. In an embodiment, the seat base and the seat may not be detached functionally; in other words, the bottom portion of a seat may be regarded as the seat base or the seat base 142 and the seat 144 can be non-separately or monolithically connected.

As discussed above, the driving device of the invention requires a smaller installation space than the soothing mechanism in the prior art, so the design of the invention can be easily applied to a current infant seat. Furthermore, because the specific profile of the interfering surface can be easily designed such as by a cam design, or be altered easily such as by replacing another driving part with none or less influence on the other components, the driving device is capable of providing a more complicated soothing motion and a more flexible mechanism than the soothing mechanism in the prior art, which can bring the convenience of use and the application flexibility to the user.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A soothing apparatus for infant seat, comprising:

an apparatus base;

a seat base disposed on the apparatus base; and a driving device comprising a driving part and a follower, the driving part and the follower being disposed on the apparatus base and the seat base oppositely, the driving part having a guiding groove with an interfering surface on inner walls of the guiding groove with a specific profile, the follower inserted into the guiding groove from above and keeping contacting the interfering surface such that the seat base is moved through the follower relative to the apparatus base in accordance with the specific profile when the interfering surface moves relative to the follower, wherein the interfering surface comprises a bottom surface and two sidewall surfaces of the guiding groove, movement of the follower is restricted by the bottom surface of the guiding groove and the two sidewall surfaces of the guiding groove, and the sidewall surfaces are disposed opposite one another and are substantially perpendicular to the bottom surface.

2. The soothing apparatus of claim 1, wherein the seat base is pivotally connected to the apparatus base.

3. The soothing apparatus of claim 1, wherein the seat base has a docking structure for docking a seat in various orientations.

4. The soothing apparatus of claim 1, wherein the guiding groove is a curved guiding groove and the driving part moves front and back and in a linear direction.

5. The soothing apparatus of claim 1, wherein the driving device comprises a motor for moving or rotating the driving part.

6. The soothing apparatus of claim 1, further comprising a supporting structure for the apparatus base to be placed thereon.

7. The soothing apparatus of claim 6, wherein the supporting structure is one selected from a group consisting of a pedestal, a plurality of foldable legs, and a plurality of detachable legs.

8. An infant seat, comprising:

an apparatus base;

a seat assembly comprising a seat base disposed on the apparatus base; and a driving device comprising a driving part and a follower, the driving part and the follower being disposed on the apparatus base and the seat base oppositely, the driving part having a guiding groove with an interfering surface on inner walls of the guiding groove with a specific profile, the follower inserted into the guiding groove from above and keeping contacting the interfering surface such that the seat assembly is moved through the follower relative to the apparatus base in accordance with the specific profile when the interfering surface moves relative to the follower, wherein the interfering surface comprises a bottom surface and two sidewall surfaces of the guiding groove, movement of the follower is restricted by the bottom surface of the guiding groove and the two sidewall surfaces of the guiding groove, and the sidewall surfaces are disposed opposite one another and are substantially perpendicular to the bottom surface.

9. The infant seat of claim 8, wherein the seat assembly is pivotally connected to the apparatus base by the seat base.

10. The infant seat of claim 8, wherein the seat assembly comprises a seat docked with a docking structure of the seat base in various orientations.

11. The infant seat of claim 8, wherein the guiding groove is a curved guiding groove and the driving part moves front and back and in a linear direction.

12. The infant seat of claim 8, wherein the driving device comprises a motor for moving or rotating the driving part.

13. The infant seat of claim 8, further comprising a supporting structure for the apparatus base to be placed thereon.

14. The infant seat of claim 13, wherein the supporting structure is one selected form a group consisting of a pedestal, a plurality of foldable legs, and a plurality of detachable legs.

* * * * *